US010876341B2

(12) United States Patent
Taylor et al.

(10) Patent No.: US 10,876,341 B2
(45) Date of Patent: Dec. 29, 2020

(54) DOOR DRIVE SYSTEM

(71) Applicant: Brose Fahrzeugteile GmbH & Co. Kommanditgesellschaft, Bamberg, Bamberg (DE)

(72) Inventors: Kim Taylor, Farmington Hills, MI (US); Andrew Lakerdas, London (CA); Mark Farrugia, Clarkston, MI (US); Alwin Macht, Lake Orion, MI (US); Anil Bhat, Rochester Hills, MI (US); Arnd Herwig, Oakland Township, MI (US); Michael Kidd, Oxford, MI (US); Travis Briggs, Macomb, MI (US)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 125 days.

(21) Appl. No.: 16/142,616

(22) Filed: Sep. 26, 2018

(65) Prior Publication Data

US 2020/0032569 A1 Jan. 30, 2020

Related U.S. Application Data

(60) Provisional application No. 62/702,391, filed on Jul. 24, 2018.

(51) Int. Cl.
*E05D 15/30* (2006.01)
*E05D 3/14* (2006.01)
(Continued)

(52) U.S. Cl.
CPC ..... *E05D 15/30* (2013.01); *E05D 3/147* (2013.01); *E05D 15/34* (2013.01);
(Continued)

(58) Field of Classification Search
CPC ..... E05D 3/147; E05D 15/34; E05D 15/30; E05F 2015/631
See application file for complete search history.

(56) References Cited

U.S. PATENT DOCUMENTS 2,701,135 A * 2/1955 Balestrieri ..... E05D 15/34 49/363
4,087,939 A * 5/1978 Elguindy ..... E05F 17/004 49/118
(Continued)

FOREIGN PATENT DOCUMENTS

CA 2320649 A1 3/2002
CN 102930098 A 2/2013
(Continued)

*Primary Examiner* — Catherine A Kelly
(74) *Attorney, Agent, or Firm* — Brooks Knshman, P.C.

(57) ABSTRACT

A door drive assembly including: a drive arm including a first end configured to be rotatably coupled to the body and a second end configured to be rotatably coupled to the door. The door drive assembly also includes a drive mechanism coupled to the drive arm and configured to rotate the drive arm between an open position and a closed position. The door drive assembly also includes a control arm including a first end configured to be rotatably coupled to a vehicle body and a second end configured to be rotatably coupled to the door. The door drive assembly also includes a race configured to be disposed between the body and the first end of the control arm where the first end of control arm is configured to translate by a first distance along the race as the drive arm rotates between the open and closed positions.

19 Claims, 9 Drawing Sheets

(51) Int. Cl.
*E05D 15/34* (2006.01)
*E05F 15/63* (2015.01)

(52) U.S. Cl.
CPC ... *E05F 2015/631* (2015.01); *E05Y 2900/506* (2013.01); *E05Y 2900/531* (2013.01)

(56) References Cited

U.S. PATENT DOCUMENTS

| | | | | |
|---|---|---|---|---|
| 4,917,446 | A * | 4/1990 | Mariani | E05D 15/34 312/325 |
| 5,507,119 | A | 4/1996 | Sumiya et al. | |
| 6,030,025 | A * | 2/2000 | Kanerva | B60J 5/047 296/146.12 |
| 6,175,991 | B1 | 1/2001 | Driesman et al. | |
| 6,183,039 | B1 | 2/2001 | Kohut et al. | |
| 6,196,618 | B1 * | 3/2001 | Pietryga | B60J 5/0479 16/82 |
| 6,305,737 | B1 | 10/2001 | Corder et al. | |
| 6,382,705 | B1 * | 5/2002 | Lang | B60J 5/0479 296/146.12 |
| 6,447,054 | B1 * | 9/2002 | Pietryga | B60J 5/0479 296/146.1 |
| 6,606,763 | B1 | 8/2003 | Bruckner | |
| 6,647,592 | B2 | 11/2003 | Presley | |
| 6,817,065 | B1 | 11/2004 | Bruckner | |
| 6,997,504 | B1 | 2/2006 | Lang et al. | |
| 7,364,219 | B2 * | 4/2008 | Lowson | B60J 5/062 296/146.1 |
| 7,644,976 | B2 * | 1/2010 | Suzuki | B60J 5/0497 292/216 |
| 7,748,770 | B2 | 7/2010 | Heuel et al. | |
| 7,798,557 | B2 | 9/2010 | Elliott et al. | |
| 7,946,079 | B2 | 5/2011 | Brown | |
| 8,096,605 | B2 | 1/2012 | Heuel et al. | |
| 8,096,606 | B2 | 1/2012 | Hanaki et al. | |
| 8,307,512 | B2 * | 11/2012 | Osaki | E05D 15/46 16/366 |
| 8,765,227 | B2 * | 7/2014 | Heuel | B05B 13/0292 427/299 |
| 8,893,436 | B2 * | 11/2014 | Choi | B60J 5/0468 296/155 |
| 8,904,600 | B2 * | 12/2014 | Sugasawara | E05D 15/34 16/366 |
| 9,217,269 | B2 | 12/2015 | Lobkovich et al. | |
| 9,605,465 | B2 * | 3/2017 | Wojdyla | E05D 15/28 |
| 9,605,469 | B2 | 3/2017 | Henseleit et al. | |
| 9,677,318 | B2 | 6/2017 | Rosales et al. | |
| 10,384,519 | B1 * | 8/2019 | Brown | E05D 15/101 |
| 10,407,961 | B2 * | 9/2019 | Fox | E05D 15/34 |
| 2005/0264029 | A1 * | 12/2005 | Bodner | E05F 1/1292 296/146.8 |
| 2010/0095595 | A1 | 4/2010 | Hanaki et al. | |
| 2013/0074285 | A1 | 3/2013 | Hall et al. | |
| 2014/0173989 | A1 | 6/2014 | Choi | |
| 2018/0044956 | A1 | 2/2018 | Gerhardt et al. | |
| 2018/0087304 | A1 | 3/2018 | Bauer et al. | |
| 2018/0178637 | A1 | 6/2018 | Brion et al. | |

FOREIGN PATENT DOCUMENTS

| | | | | |
|---|---|---|---|---|
| CN | 106121415 | A | 11/2016 | |
| CN | 107901738 | A | 4/2018 | |
| CN | 207535665 | U | 6/2018 | |
| CN | 108301726 | A | 7/2018 | |
| DE | 29701617 | U1 | 3/1997 | |
| DE | 3705768 | A1 | 9/1998 | |
| DE | 19712382 | C1 | 9/1998 | |
| DE | 19945755 | A1 | 3/2001 | |
| DE | 10141628 | A1 | 3/2002 | |
| DE | 10118303 | C1 | 5/2002 | |
| DE | 10341922 | A1 | 4/2005 | |
| DE | 102004027773 | A1 | 1/2006 | |
| DE | 102004029831 | B3 | 1/2006 | |
| DE | 102005018489 | B3 | 3/2006 | |
| DE | 102005010579 | B3 | 4/2006 | |
| DE | 102005006916 | A1 | 8/2006 | |
| DE | 102005006917 | A1 | 8/2006 | |
| DE | 102005006932 | A1 | 8/2006 | |
| DE | 102005026773 | A1 | 4/2007 | |
| DE | 102007003601 | A1 | 7/2007 | |
| DE | 102010018302 | A1 | 5/2011 | |
| DE | 202010003634 | U1 | 9/2011 | |
| DE | 202014006804 | U1 * | 9/2014 | E05B 3/147 |
| DE | 202014006804 | U1 | 10/2014 | |
| DE | 102015006177 | A1 | 12/2015 | |
| EP | D125703 | A2 | 11/1984 | |
| FR | 1267803 | A | 7/1961 | |
| FR | 2858994 | A1 | 2/2005 | |
| GB | 2506431 | A | 4/2014 | |
| GB | 2536969 | A | 10/2016 | |
| JP | S63268888 | A | 11/1988 | |
| JP | H03140583 | A | 6/1991 | |
| JP | H08282292 | A | 10/1996 | |
| JP | 2006088781 | A | 4/2006 | |
| JP | 2009061998 | A | 3/2009 | |
| KR | 20080068221 | A | 7/2008 | |
| KR | 101568344 | B1 | 11/2015 | |
| WO | 2008151503 | A1 | 12/2008 | |

* cited by examiner

DOOR DRIVE SYSTEM

CROSS-REFERENCE TO RELATED APPLICATIONS

This application claims the benefit of U.S. provisional application Ser. No. 62/702,391 filed Jul. 24, 2018, the disclosure of which is hereby incorporated in its entirety by reference herein.

TECHNICAL FIELD

The present disclosure relates to systems for vehicle closures.

BACKGROUND

Vehicles may include one or more doors, such as closures, hatches, tailgates, liftgates. Certain vehicles may include a pair of doors that open by moving away from parallel to the body of the vehicle. In particular, autonomous vehicles may require doors capable of opening and closing in response to a predetermined set of conditions.

SUMMARY

One or more computer programs can be configured to perform particular operations or actions by virtue of including instructions that, when executed by data processing apparatus, cause the apparatus to perform the actions. One general aspect includes a door drive assembly for a bus provided with a body and a door configured to move away from and along the body, the door drive assembly including: a drive arm including a first end configured to be rotatably coupled to the body and a second end configured to be rotatably coupled to the door. The door drive assembly also includes a drive mechanism coupled to the drive arm and configured to rotate the drive arm between an open position and a closed position. The door drive assembly also includes a control arm including a first end configured to be rotatably coupled to a vehicle body and a second end configured to be rotatably coupled to the door. The door drive assembly also includes a race configured to be disposed between the body and the first end of the control arm where the first end of control arm is configured to translate by a first distance along the race as the drive arm rotates between the open and closed positions. Other aspects may include corresponding computer systems, apparatus, and computer programs recorded on one or more computer storage devices, each configured to perform a number of actions.

Implementations may include one or more of the following features. The door drive assembly further including a guide arm disposed between the control and the drive arm, where the guide arm is configured to separate the drive arm from the control arm by a predetermined distance. The door drive assembly further including a bracket that is attachable to the body where the bracket is provided with a slot and where an inner surface of the slot defines the race.

One general aspect includes a door drive system for use with vehicle including a vehicle body and a pair of doors configured to move away from and along the vehicle body, the door drive system including: a drive arm and a control arm configured to be coupled to one of the doors. The door drive system also includes a drive mechanism, provided with a motor and a gear set. The door drive system also includes a main shaft engaged with the gear set. The door drive system also includes an output shaft coupled to the drive arm and the main shaft and where rotation of the main shaft rotates the output shaft and the drive arm.

Implementations may include one or more of the following features. The door drive system further including: a pinion gear fixed to the main shaft. The door drive system may also include a sector gear fixed to the output shaft where the pinion gear engages the sector gear so that rotation of the pinion gear rotates the sector gear and output shaft. The door drive system where one end of the output shaft includes a spline that engages the sector gear. The door drive system where the gear set includes: a sun gear. The door drive system may also include a planetary gear configured to engage and rotate about the sun gear. The door drive system may also include a ring gear engaged with the planetary gear and coupled to the main shaft.

One general aspect includes a door drive system for use with vehicle including a vehicle body and a pair of doors configured to move away from and along the vehicle body, the door drive system including: a drive arm and a control arm configured to be coupled to one of the doors. The door drive system also includes a drive mechanism, provided with a motor and a gear set where rotation of the motor in a first rotational direction rotates the gear set to pivot the drive arm, and the control arm away from and along the body. The door drive system also includes a main shaft engaged with the gear set. The door drive system also includes an output shaft coupled to the drive arm and the main shaft, where rotation of the main shaft rotates the output shaft and the drive arm. The door drive system also includes a controller configured to change the rotation of at least one of the motors from one of the first or second directions, responsive to a comparison of a sensor value to a threshold condition.

Implementations may include one or more of the following features. The door drive system where the controller is further configured to stop the rotation of the motor, responsive to a comparison of a second sensor value to a threshold condition. The door drive system where the controller is further configured to power at least one of the motors, responsive to receiving a signal indicative of a subsequent ingress/egress event.

A system of one or more computers can be configured to perform particular operations or actions by virtue of having software, firmware, hardware, or a combination of them installed on one or more of the implementations that describe above. In operation, the system may cause one or more of the implementations to perform the actions.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
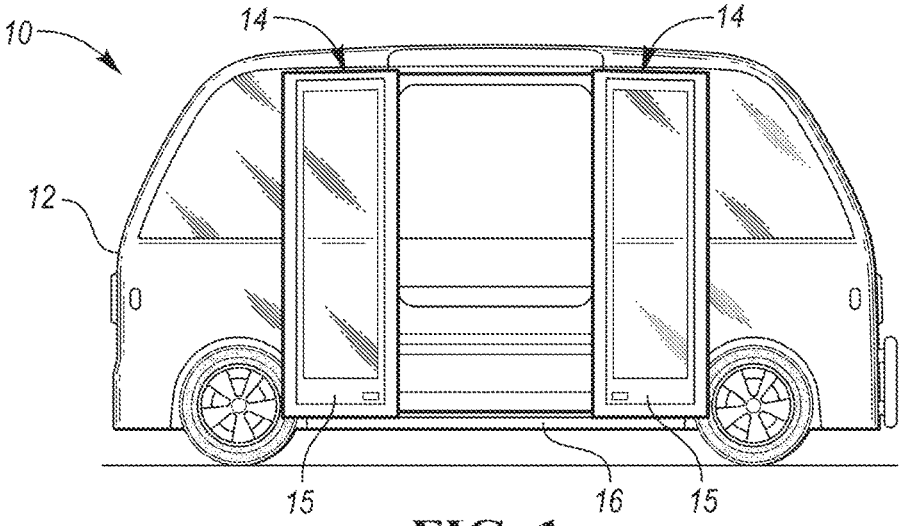
FIG. 1 is a plan view of a vehicle that includes an exemplary door assembly.

Referring to FIG. 1, a plan view of a vehicle 10 that includes a vehicle body 12 and one or more door assemblies 14. The door assemblies 14 may move doors 15 from a closed position to an open position (illustrated) and vice-versa. The door assemblies 14 may actuate or open the doors 15 in a two-step manner; in a first step the door assemblies 14 move in a first direction that is transverse to the longitudinal direction of the vehicle and in the second step the door assemblies move in a direction that is parallel to the longitudinal direction of the vehicle.

Figure 2:
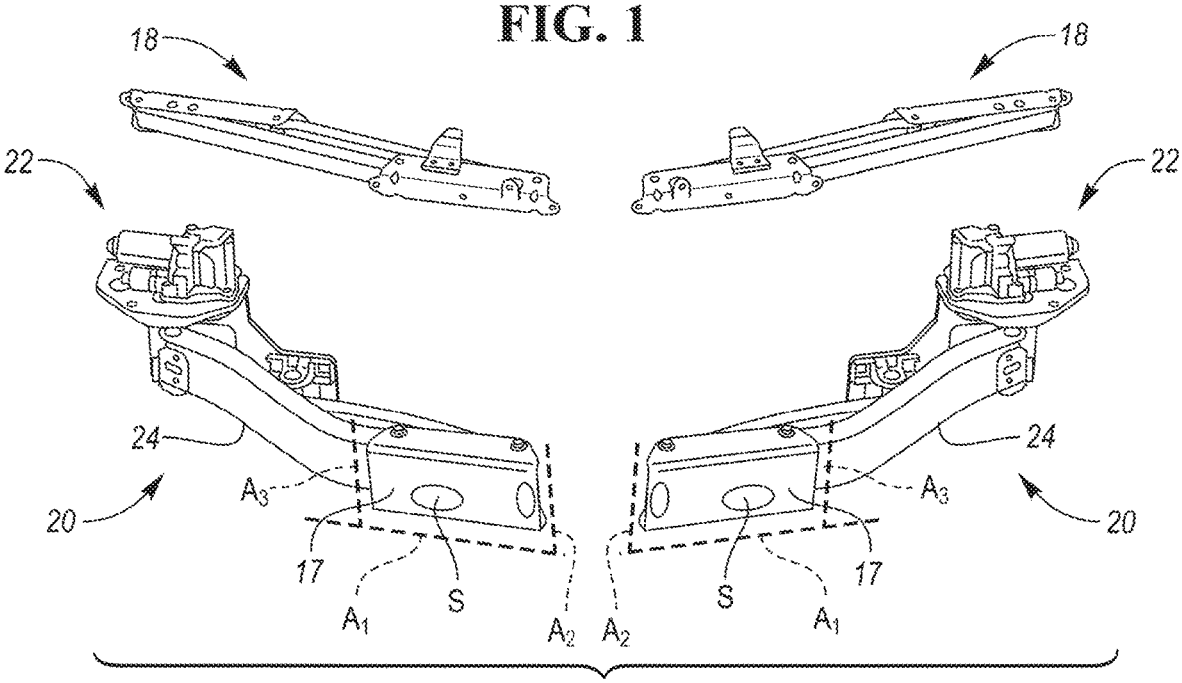
FIG. 2 is a perspective view of a pair of exemplary upper link assemblies and a pair of exemplary lower actuation assemblies.

Referring to FIG. 2, a perspective view of a pair of exemplary upper link assemblies 18 and a pair of exemplary lower actuation assemblies 20. The upper link assemblies 18 and lower actuation assemblies 20 may be part of the door assemblies 14 described above. For example, one of the upper link assemblies 18 may couple an upper portion of the door 15 to the body 12 and the lower actuation assembly 20 may couple a lower portion of the door 15 to the body 12. The terms upper and lower are used for clarity and are not limiting. In one or more embodiments, the lower actuation assembly 20 may be placed above the upper link assembly 18. The lower actuation assembly 20 may include a door attachment portion 17 that may be fixed to a lower link assembly 24. The lower link assembly may be coupled to or operatively engaged with a drive system 22. The drive system 22 may be operated (e.g., powered or manually actuated) to move the lower link assembly 24 between the open and closed positions. In one or more embodiments, the upper link assemblies may be slaves or follows the movement of the lower actuation assemblies 20.

The lower actuation assemblies 20 may be fixed, directly or indirectly, to a rocker panel 16 of the vehicle body 12. One or more portions of the lower actuation assembly 20 may include sensors S configured to detect one or more objects or obstacles. The sensors S may include tactile sensors, capacitive sensors, visual sensors, proximity sensors, or some combination thereof. Tactile sensors may be of different types including piezo-resistive, piezoelectric, capacitive, and elasto-resistive sensors. Visual sensors may include cameras or other suitable imaging devices. Proximity sensors may refer to sensors such as radar, LIDAR, magnetic, sonar, etc.

In one or more embodiments, the door attachment bracket 17 may include a sensor S that is configured to detect an obstacle that is adjacent to an outer portion of the door attachment bracket 17 as indicated by the dashed line $A_1$. As another example, the door attachment bracket may include one or more sensors S configured to detect an obstacle positioned between each of the door attachment brackets 17 or between the door attachment bracket 17 and the body 12 of the vehicle 10 as indicated by the dashed line $A_2$. As another example, the door attachment bracket 17 may include sensors S configured to detect an obstacle positioned between the door attachment bracket 17 and a periphery of the vehicle body 12, as indicated by the dashed lines $A_3$.

Figure 3:
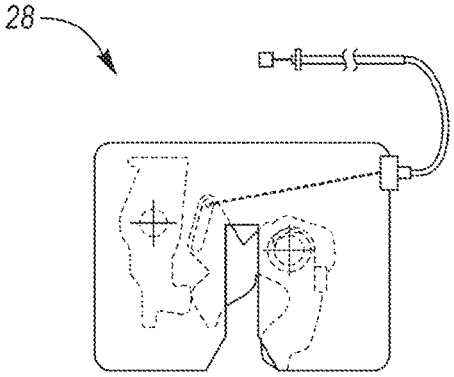
FIG. 3 is a top view of an exemplary two-stage latch assembly.

Referring to FIG. 3, a two-stage latch assembly 28 is illustrated. In the closed position, the latch assembly 28 of each of the lower actuation assemblies 20 may engage a striker of a striker assembly (not illustrated). The striker assembly may be fixed or connected to the rocker panel 16. In one or more embodiments, the latch assembly may be coupled to a cinching mechanism. The cinching mechanism may be configured to move the door 15 and the two-stage latch from a secondary latch position to a primary latch position. An exemplary cinching mechanism and two-stage latch is described in U.S. Pat. No. 9,677,318 and is hereby incorporated by reference in its entirety.

Referring to FIGS. 4A through 4D, an exemplary lower link assembly 24 is provided. The lower link assembly 24 includes a drive link 80 that may be coupled to the output shaft 190. In one or more embodiments, the output shaft 190 and the drive link 80 may rotate with one another or the drive link 80 may rotate relative to the output shaft 190. A control link 82 may be coupled to the drive link 80 to define a four-bar linkage. The control link 82 may be coupled to a body attachment bracket 84 by a fastener 86. The fastener 86 and output shaft 190 may be attached to the body attachment bracket 84 by brackets 92.

Figure 4B:
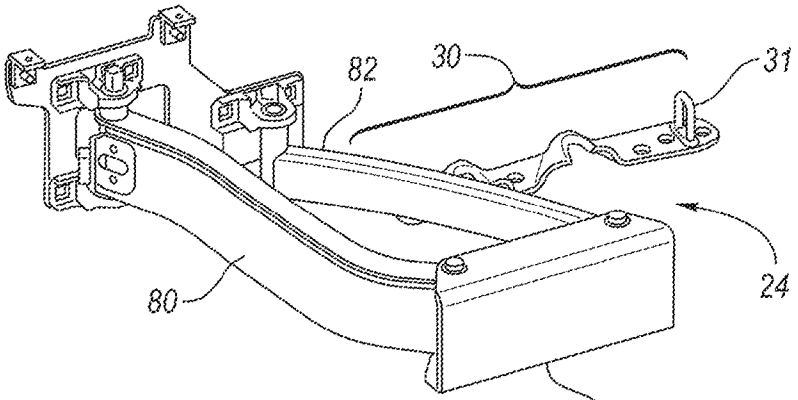
FIG. 4B is a perspective view of one of the exemplary lower actuation assemblies in a partially-open position.
Figure 4D:
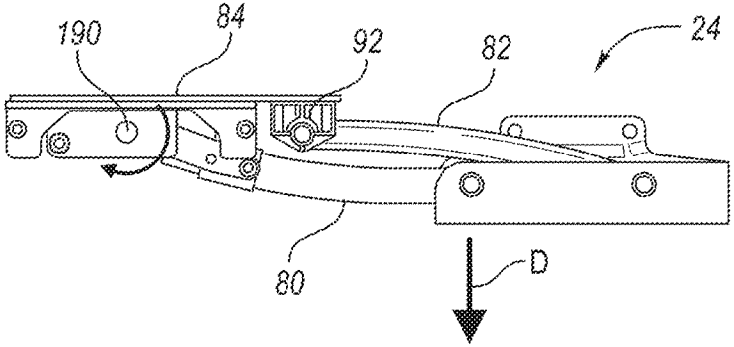
FIG. 4D is a top view of an exemplary lower actuation assembly in a closed position.
Figure 4A:
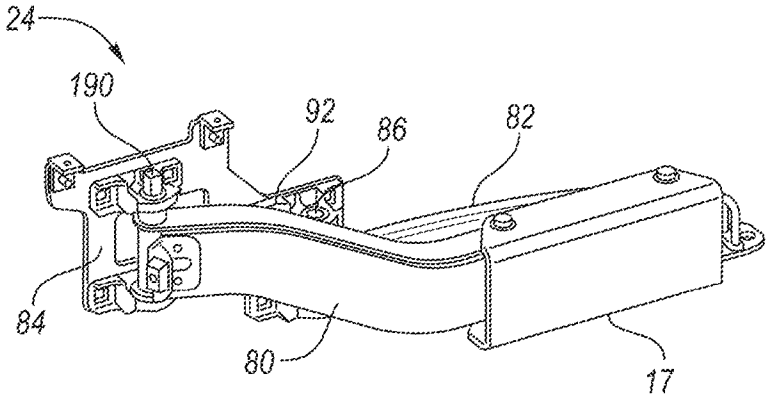
FIG. 4A is a perspective view of one of the exemplary lower actuation assemblies in a closed position.
Figure 4C:
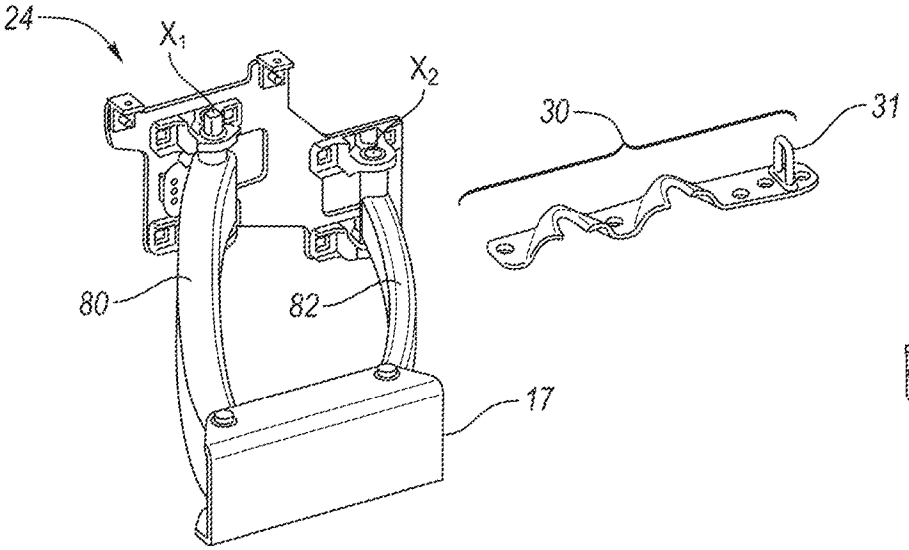
FIG. 4C is a perspective view of one of the exemplary lower actuation assemblies in an open position.

Referring specifically to FIG. 4A, a perspective view of the lower link assembly 24 is illustrates the lower link assembly 24 in the closed position. The lower link assembly 24 may rotate about a pivot point $X_1$. In the closed position, the drive link 80 and the control link 82 may be parallel to one another. In FIG. 4B, the lower link assembly 24 is positioned in a partially opened position. In this position the door attachment bracket 17 may be spaced apart from the striker assembly 30. In FIG. 4C, the lower link assembly 24 is the open position. In the open position the drive link 80 and the control link 82 may be parallel to one another, and the door attachment bracket 17 may be spaced further away from the striker assembly 30 than its position in the partially open position.

Referring specifically to FIG. 4D, a top view of the lower link assembly 24 is illustrated. A moment M may be applied about the pivot point $X_1$ so that the drive link 80 rotates about pivot point $X_1$ and the control link 82 rotates about pivot point $X_2$ between the closed and open positions. Rotation of the drive link 80 and the control link 82 moves the door attachment bracket 17 along the direction indicated by directional arrow D.

Figure 5A:
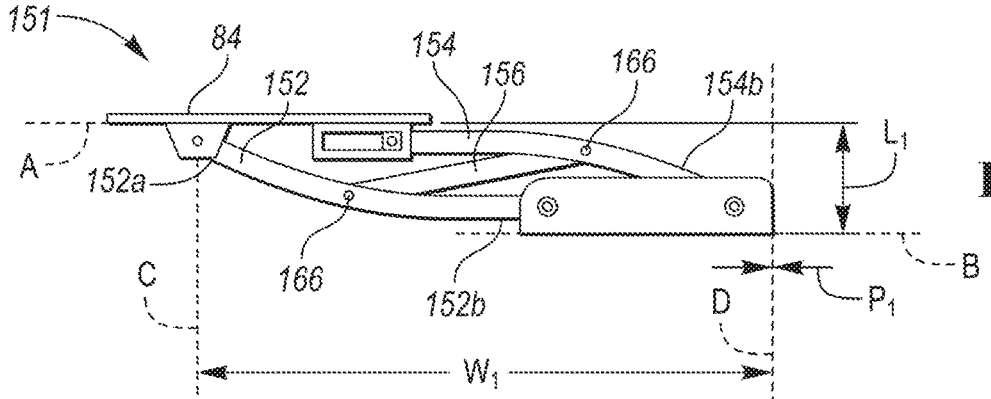
FIG. 5A is a top view of another exemplary lower actuation assembly in a closed position.
Figure 5B:
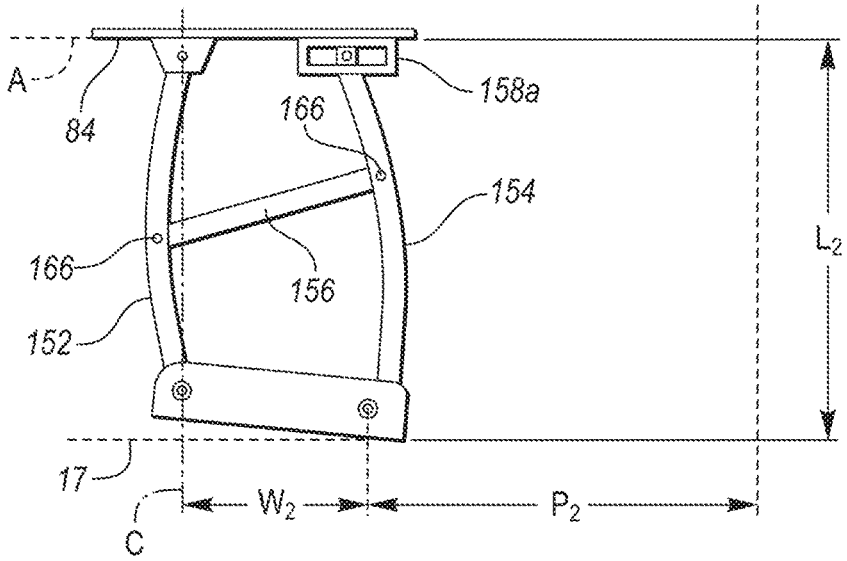
FIG. 5B is a top view of another exemplary lower actuation assembly in an open position.
Figure 5C:
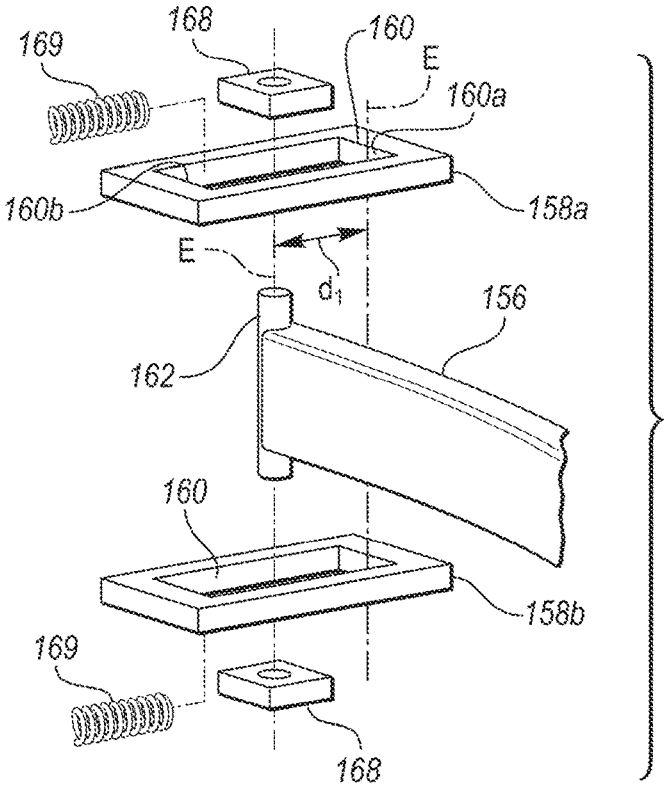
FIG. 5C is an exploded view of another exemplary lower actuation assembly in an open position.

FIGS. 5A-5C illustrate an exemplary lower actuation assembly 151 according to one or more embodiments. The lower actuation assembly 151 may include a five-bar link mechanism comprised of a drive arm 152, a control arm 154, and a guide arm 156 disposed between the drive arm 152 and the control arm 154. In one or more embodiments, the drive arm 152 may be fixed to the output shaft 190. The segment 98 may be fixed to the output shaft 190 so that as the segment 98 rotates, the drive arm 152 rotates. The guide arm 156 may be pivotally attached to the drive arm 152 and the control arm 154 by pins 166, for example. The pivotal fixation of the guide arm 156 may facilitate rotation of the drive arm 152 and the control arm 154 while maintaining a fixed distance between the drive arm 152 and the control arm 154.

The control arm 154 may include a proximal end 154*a* and a distal end 154*b*. The proximal end 154*a* of the control arm 154 may be pivotally coupled to one or more guide brackets 158. For example, the proximal end 154*a* of the control arm 154 may be pivotally coupled to a guide bracket 158 that may be fixed to the body attachment bracket 84. The guide bracket 158 may include a race, such as a slot 160. The term race generally refers to a surface that acts as a guide for one or more moving components. The race may be defined one or more surfaces of the slot 160. For example, a raised section that is configured to engage the translating pin 162 may define the race.

A translating pin 162 may be disposed within the slot 160 and coupled to the control arm 154 so that the control arm 154 and the translating pin 162 rotate between open and closed positions. In one or more embodiments, the translating pin 162 may be pivotally coupled to the control arm such that the control arm 154 rotates with respect to the translating pin 162.

Movement of the lower actuation assembly 151 may be described with reference to a number of planes. A first plane A, may be defined by a front surface of the body attachment bracket 84. A second plane B may be defined by a front surface of the door attachment bracket 17. A third plane C may extend in a direction that is orthogonal to the first plane A through a center of the output shaft 190. A fourth plane D may be defined by one end of the door attachment bracket 17.

When the lower actuation assembly 151 is in the closed position, the front surface of the door attachment bracket 17, may be spaced apart from the first plane A, defined by the vehicle attachment bracket 84 by a distance $L_1$. Secondly, the translating pin 162 may be disposed closer to a first end 160*a* of the slot 160 with respect to a second end 160*b* of the slot 160. When the lower actuation assembly 151 is in the closed position, an inner end of the door attachment bracket 17 may be spaced apart from the third plane C by a distance $W_1$. A distance between the inner end of the door attachment bracket 17 and the fourth plane D may define a pitch $P_1$. The pitch may refer to the distance between the vehicle door attachment bracket, and the vehicle door, and the opening of the vehicle.

When the lower actuation assembly 151 is in the open position, the front surface of the door attachment bracket may move by a second distance La, that is greater than Li. As shown, the inner end of the door attachment bracket 17 may move by a distance or pitch Pa so that the width is decreased to W2. As the lower actuation assembly 151 moves from the closed position (FIG. 5A) to the open position (FIG. 5B), the translating pin 162 may translate along the slot 160 away from the first end 160*a* of the slot 160 to the second end 162*b* of the slot 160 by a distance di. In one or more embodiments, the width Wz and the distance di may be inversely proportional to one another. In other words, as the distance di increases, the distance between the third plane C and the inner end of the door attachment bracket 17 decreases. Likewise, the pitch P may increase as the distance di moved by the translating pin 162.

The orientation of the slot 160 may be arranged in a direction that is parallel to the first plane A. In one or more embodiments, the slot 160 may be oriented or arranged in a direction that is oblique to the first plane such that the translating pin 162 moves towards the vehicle body 12.

Referring specifically to FIG. 5C, a partial-exploded view of the lower actuation assembly 151 in the open position is illustrated. For clarity, the vehicle attachment bracket 17, guide arm 156, and drive arm 152 are not illustrated. In one or more embodiments, an upper guide bracket 158*a* and a lower guide bracket 158*b*, each disposed above and below the control arm 154. A bushing 168 may be provided within each of the guides or slots 160 defined by the guides brackets 158. The bushing 168 may be sized so that it may translate (e.g., slide) within the slot 160. Each of the bushings 168 may define an aperture 170 that may receive the translating pin 162 so that the translating pin 162 and control arm 154 may rotate with respect to each of the bushings 168.

The translating pin 162 may move towards the first end 160*a* of the slot 160, when moved the closed position, due to the weight of the door 15 and the drive and control arms. In one or more embodiments, a biasing device, such as a spring 169, may bias the translating pin 162 towards the first end 160*a* of the slot 160 in line with the dashed line E. In one or more embodiments, the translating pin 162 may be biased by a solenoid or another suitable actuator. Also, the translating pin 162 may be held or latched in this position by a latch or locking mechanism. When drive system 22 is actuated to rotate the drive arm 152 to move away from and along the side of the vehicle body 12, the control arm rotates and moves (e.g., slides, translates, articulates) by distance di to a second position E'.

Figure 6:
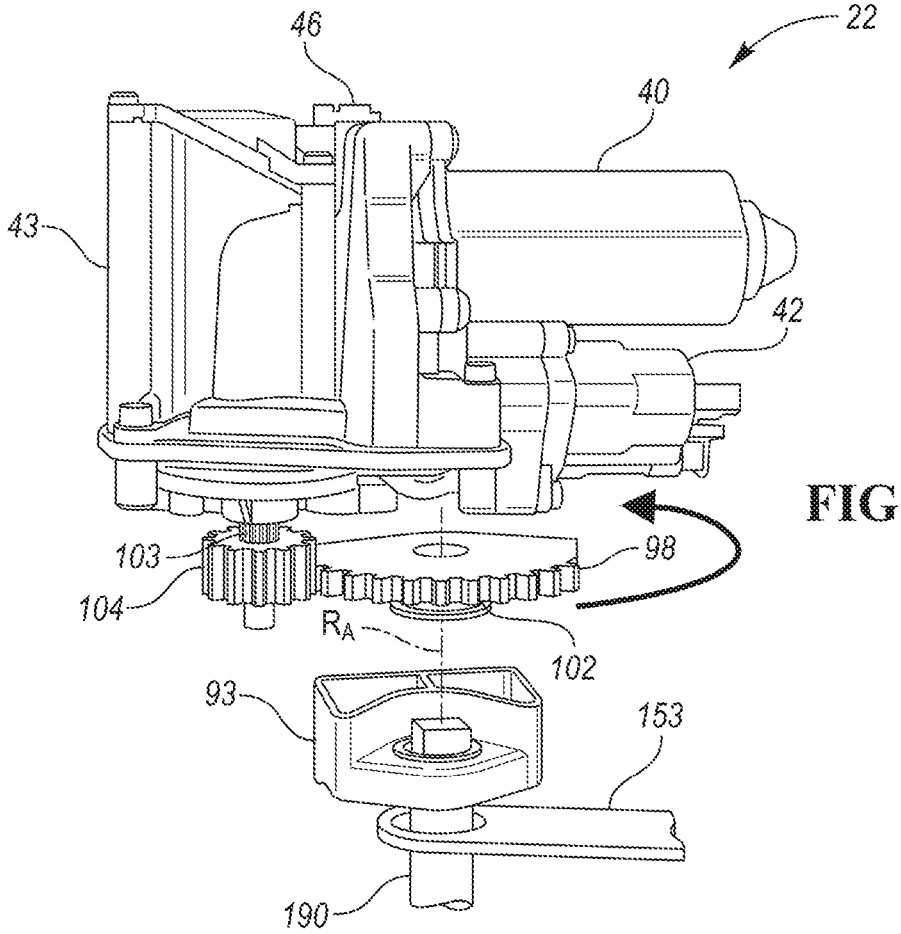
FIG. 6 is a perspective view of an exemplary drive system.

Referring to FIGS. 6, a drive system 22 according to one or more embodiments is provided. The drive system 22 may include a drive motor 40 and a locking motor, such as a clutch motor 42. The drive motor 40 and the clutch motor may each be attached or fixed to a cover 43 of the drive system. The drive system 22 may include a main shaft 103 that includes a portion that is disposed within the cover 43 and a portion that extends from the cover 43. The main shaft may be operatively coupled to the drive motor 40 and fixed to the main shaft 103 so that as the main shaft is rotated, the pinion 104 is rotated. The pinion 104 may rotate the output gear 98 that may be coupled to the output shaft 190 by a bushing 102. As the output gear 98 rotates, the bushing and the output shaft 190 may rotate so that a drive arm 153 fixed to the output shaft 190 rotates. The output shaft 190 may rotate about the rotational axis $R_A$ that may be defined by a bracket 93 that may be fixed, directly or indirectly to the vehicle body 16.

An exemplary drive system 22 and clutch mechanism are each described in U.S. Publication No. 2018/0216392 and are hereby incorporated by reference.

Figure 7:
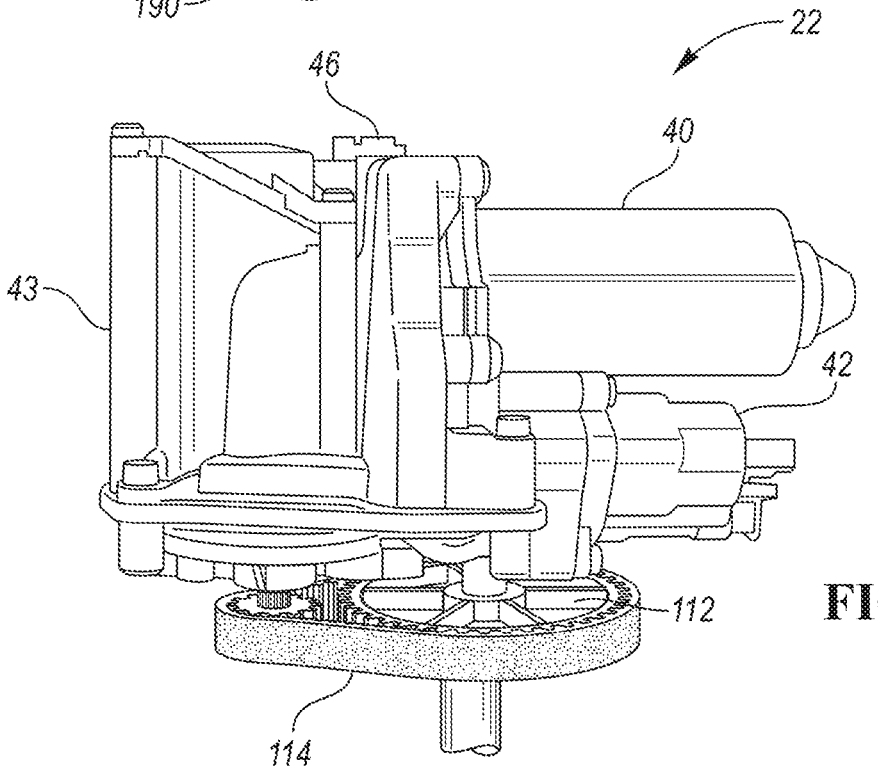
FIG. 7 is a partial-exploded-perspective view of an exemplary belt-drive system.

Referring to FIG. 7, the exemplary drive system 22 according to one or more embodiments is provided. The pinion 104 may be engaged with a belt 114. The belt 114 may be operatively coupled to a gear wheel 112 so that rotation of the pinion 104 rotates the belt 114 and the belt-driven gear wheel 112. The belt driven gear wheel 112 may rotate the drive arm 80.

Figure 8:
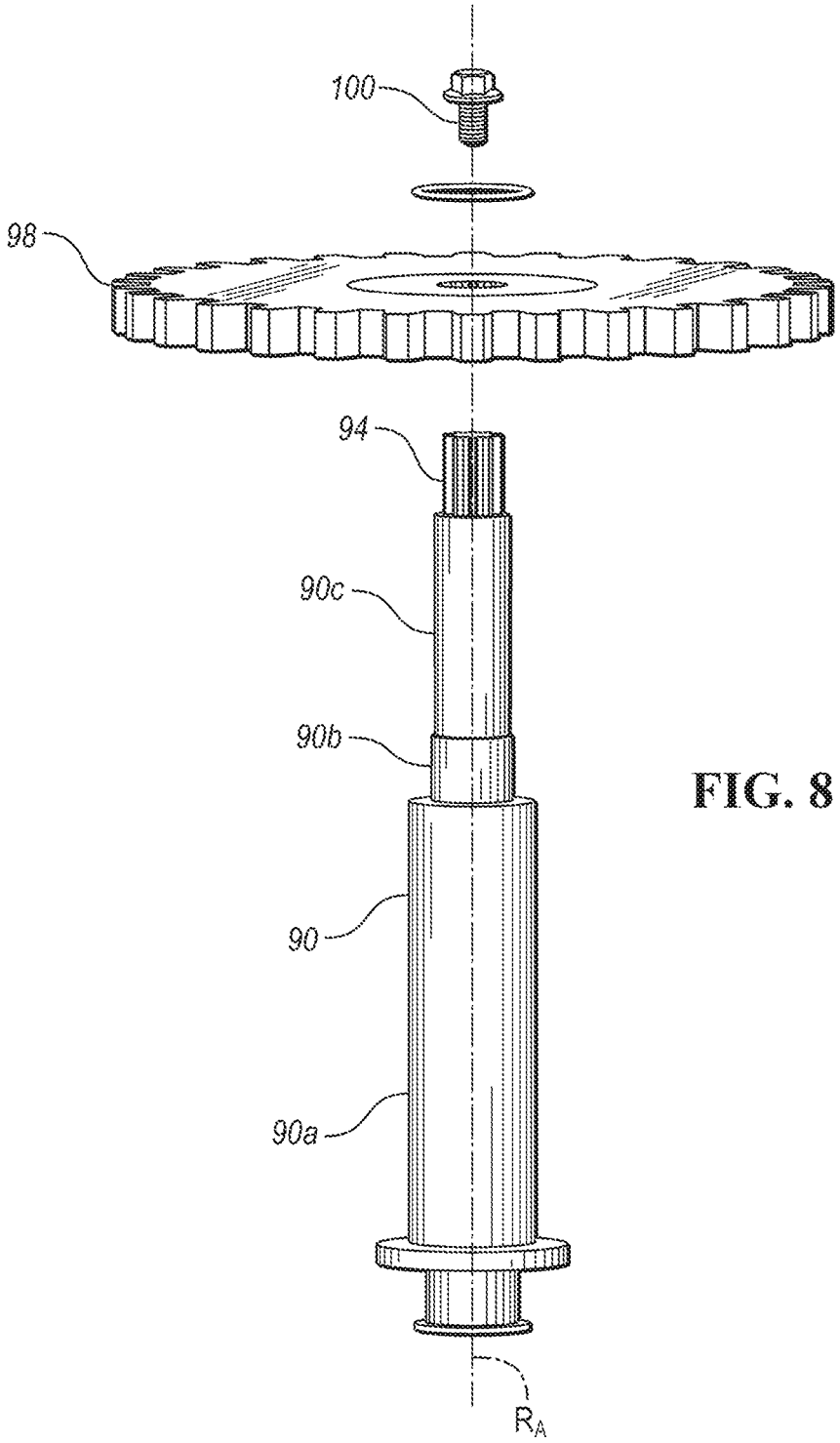
FIG. 8 is a perspective-exploded view of a main shaft and a gear segment.

Referring to FIG. 8, a perspective view of an exemplary output shaft 90 and output gear 98 are illustrated. The output shaft 90 may be tapered and include three different portions. A first portion 90*a*, may extend from one end to a middle portion 90*b*. A third portion 90*c* may extend from the middle portion 90*b* to a spline 94. The first portion 90*a* may define a diameter that is greater than the second portion 90*b* and the third portion 90*c*. The spline 94 may be configured to engage the output gear 98. The output shaft 90 and spline 94 may rotate about a rotational axis $R_A$. A fastener 100 may engage the output shaft 90 so the output gear 98 and shaft 90 are coupled to one another.

Figure 9A:
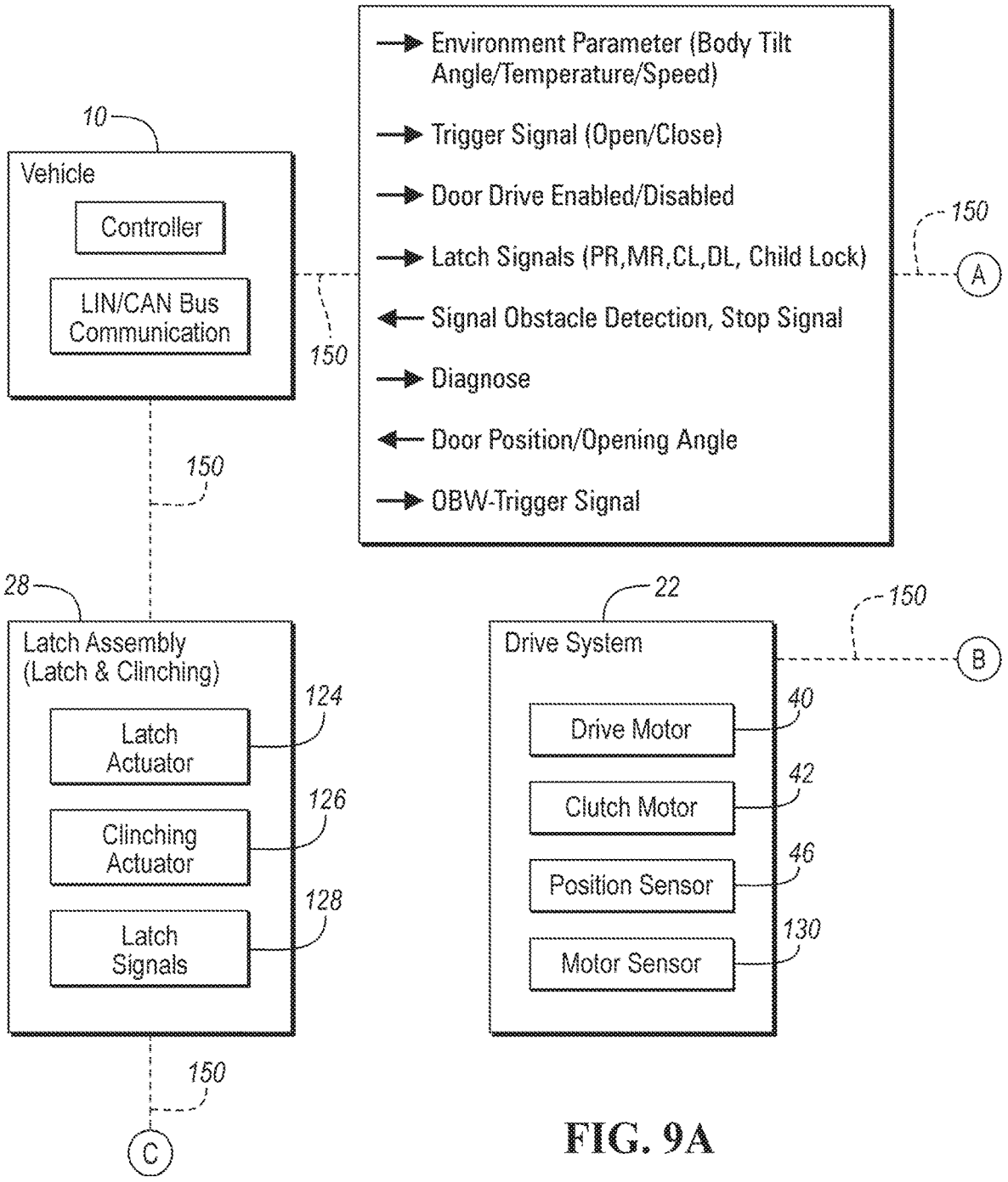
FIGS. 9A and 9B are a schematic diagram of an exemplary vehicle control system.
Figure 9B:
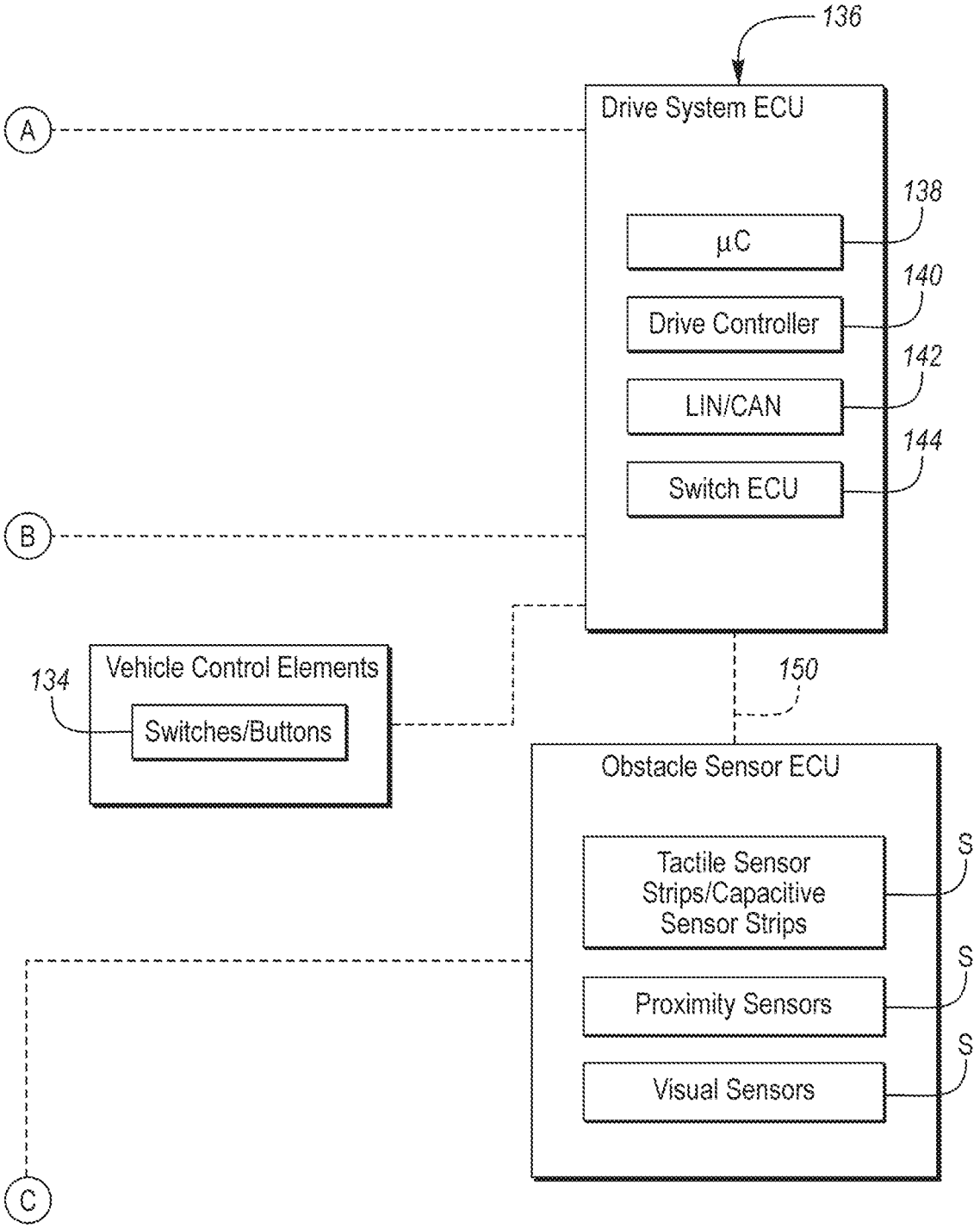

Referring to FIG. 9, a schematic diagram illustrating a control system of the vehicle 10 and lower actuation assemblies 20 is provided. The vehicle 10 may include a controller 120 that may be incorporated within or in communication with a Local Interconnect Network (LIN) or a Controlled Area Network (CAN Bus) 122. The controller 120 and LIN/CAN Bus 122 may receive signals from various sensors and communicate those signals or actions to a door drive electronic control unit (ECU) 136, the drive system 22, and latch assembly 28. In one or more embodiments, the sensors may measure the pitch and roll of the vehicle body 12, to detect whether the vehicle 10 is on an up-hill, down-hill, or side-hill gradient. Furthermore, one or more temperature sensors may be provided to measure the temperature of the air within or surrounding the vehicle. As another example, the speed of the vehicle at a given time may be measured or communicated to the controller 120. The controller 120 may also receive signals indicative of the status of the vehicle 10 (e.g., stopped, idling, rolling, driving).

In one or more embodiments, the controller 120 may be suitable for an autonomous vehicle (e.g., self-driving). In that case, the controller 120 may be configured to receive signals that are indicative of an on-boarding or off-boarding passenger. The vehicle may be equipped with various sensors (e.g., proximity sensors, LIDAR, radar, cameras) that provide signals indicative of a stop or destination where passengers may board and off-board the vehicle 10. Alternatively, the vehicle may be equipped with positioning sensors (e.g., GPS) configured to detect or predict one or more stops.

The controller 120 may provide signals to the drive system ECU 136, the drive system 22, latch assembly 28, or some combination thereof. The drive system ECU 136 may include a micro-processor 138 that may be configured control the drive motor 40, clutch motor 42, or both. A drive controller 140 may also be provided and configured to receive and send signals to and from the drive system 22. These signals may be sent via a drive system LIN/CAN Bus 142. The drive system ECU 136 may also include a switch ECU 144 that may be configured to send and receive signals from one or more switches or buttons 134 within control elements 132 of the vehicle 10 or within the latch assembly 28, or both.

As previously described, the pinion gear 104 of the drive system 22 may rotate at a predetermined speed. The predetermined speed of the pinion gear 104 may correlate to an operating speed of each of the door assemblies 14. The drive system ECU may provide a signal to the drive system 22 to alter the rotational speed of the pinion drive 104 and the operating speed of the door assemblies 14.

The door drive system 22 may include the drive motor 40, the clutch motor 42, one or more position sensors 46, and one or more motor sensors 130. The position sensor 46 may be configured to measure the angular position of the output shaft 190. The angular position of the output shaft 190 may be correlated to the position (e.g., open, closed, partially open) of the lower actuation assembly 20 and the door 15. The motor sensor or sensors 130 may be a hall sensor, ripple count sensor, or a dedicated ECU configured to detect the positional location of the drive motor 40, or clutch motor 42, or both.

The vehicle 10 may be provided with various control elements 132. As one example, the control elements may include switches or buttons 134 that may be actuated to send a signal to the controller 120 or the drive system ECU 136. As one example, a switch may be actuated when a transmission of the vehicle is placed in park. As another example, the button may be a door open/close button that may be actuated to send a signal to the drive system ECU 136 to open or close the doors 15.

The latch assembly 28 may include a latch actuator 124 and a cinching actuator 126 each configured to provide and receive various signals 128 to the controller 120. The latch actuator 124 may include an electric motor configured to move the latch from an unlocked position to a locked position and vice-versa. Movement of the latch actuator 124 may be in response to the door 15 being moved from the opened or partially opened position to the closed position and vice-versa. As described above, the latch may be a two-stage latch configured to move from a secondary latch position to a primary latch position, in response to latch signals 128 that are indicative of the latch being moved to the secondary latch position.

An obstacle sensor ECU 148 may communicate 150 with the latch assembly, drive system ECU, drive system 22, controller 120, or some combination thereof. As one example, one of the sensors S may detect an obstacle or a potential collision with an obstacle as one of the doors 15 opens or closes. In response to the sensor detecting a potential collision, the obstacle sensor ECU 148 may communicate 150 with the drive system ECU 136. Responsive to the drive system ECU 136 receiving this signal, the drive controller 140 may stop or alter the direction of the drive motor 40.

Figure 10:
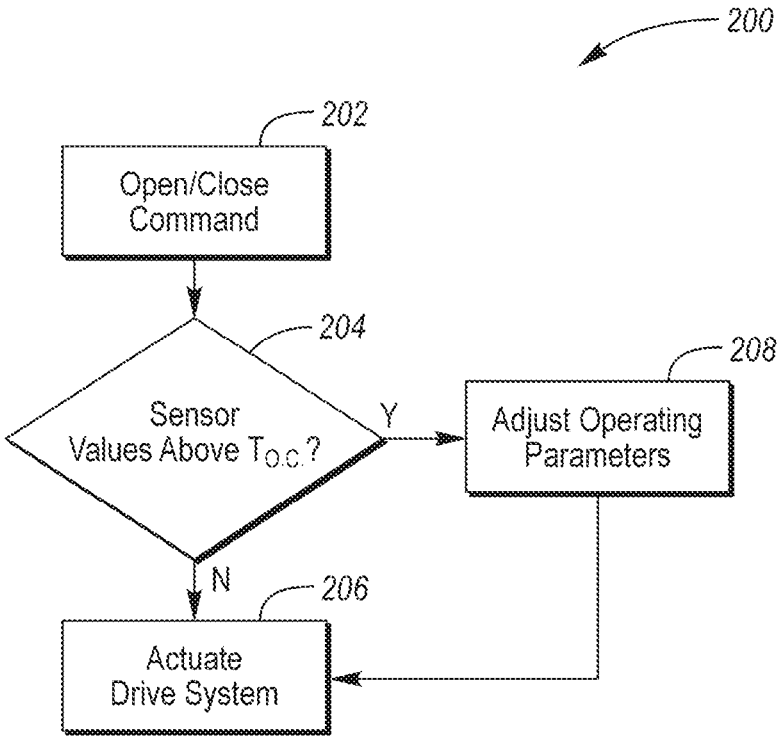
FIG. 10 is a flow-chart illustrating a method of operating the exemplary door assembly.
Figure 11:
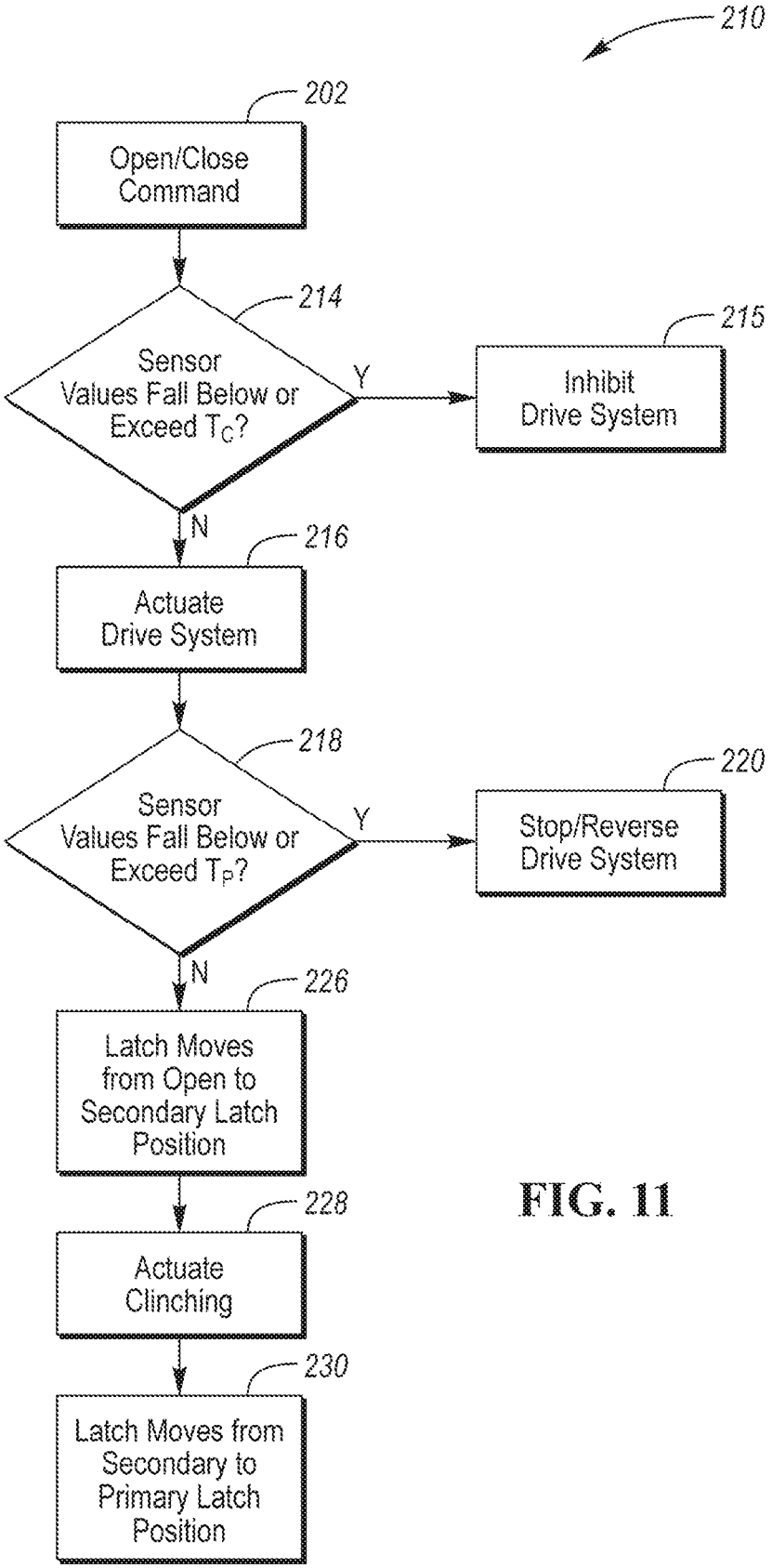
FIG. 11 is a flow-chart illustrating a method of operating the exemplary door assembly.

Control logic or functions performed by the controller 120, drive system ECU 136, obstacle sensor ECU 148, etc. may be represented by flow charts or similar diagrams, such as the flow chart 200 in FIG. 14. FIGS. 10 through 11 provide representative control strategies and/or logic that may be implemented using one or more processing strategies such as polling, event-driven, interrupt-driven, multi-tasking, multi-threading, and the like. As such, various steps or functions illustrated may be performed in the sequence illustrated, in parallel, or in some cases omitted.

The controllers and ECUs may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 120 in controlling the drive system 22.

Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein but is provided for ease of illustration and description. The control logic may be implemented primarily in software executed by a microprocessor-controlled vehicle 10, drive motor 40, locking motor 42, or controller 120.

The control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of several known physical devices that utilize electric, magnetic, and/or optical storage to keep executable instructions and associated calibration information, operating variables, and the like.

FIG. 10 illustrates a representative control strategy 200 and/or logic that at least partially depends on operating conditions of the vehicle 10. As described above, the vehicle 10 may be equipped with sensors the measure pitch and roll of the vehicle body 12. Pitch and roll of the vehicle 10 may alter the force required to open or close the door assemblies 14. Additionally, the vehicle 10 may include temperature sensors that measure the temperature of the air within or surrounding the vehicle 10. Cold temperatures (e.g., below 40° F.) may alter the efficiency of the drive system 22. In response to or independent from a command to open or close the doors in operation 202, the measured sensor values (e.g., pitch, roll, temperature) may be compared to a predetermined threshold, such as an operating condition threshold $T_{O.C.}$, as represented by operation 204. If the sensor values are equal to or below the operating condition threshold $T_{O.C.}$, the drive system 22 may be actuated, as in operation 206. If the sensor values are above the operating condition threshold $T_{O.C.}$, the drive system ECU may increase the power (e.g., current, voltage) provided to the drive motor 40, as in operation 208.

In one or more embodiments, the locking motor may be engaged to alter a gear ratio of the locking device so that a greater torque may be achieved. The term above is used for illustrative purposes only and is not meant to be limiting. Depending on the predetermined threshold, the controller may branch to operation 208 in response to the sensor values being below or equal to the operating condition threshold $T_{O.C.}$.

FIG. 11 illustrates a representative control strategy 210 and/or logic that at least partially depends on the prediction of collision, a collision, a predicted pinch condition, an actual pinch condition, or some combination thereof. In operation 202 the drive system ECU may receive and send a command to open or close the door assemblies 14. Sensor values corresponding to a collision or a predicted collision may be compared with a predetermined threshold, such as a collision threshold $T_C$, as represented by operation 214. The sensor values may be those measured along the dashed lines $A_1$ (FIG. 3). If the sensor values fall below or exceed the collision threshold $T_C$, the controller 120 or drive system ECU 136 may inhibit the drive system 22 from actuating, as represented by operation 215. If the sensor values do not fall below or exceed the collision threshold $T_C$, the controller 120 or drive system ECU 136 may actuate the drive system 22, as represented by operation 216.

In operation 218, the sensor values corresponding to a pinch condition or a predicted pinch may be compared with a predetermined threshold, such as a pinch threshold $T_P$. The sensor values may be those measured along the dashed lines $A_2$ (FIG. 2). If the sensor values fall below or exceed the collision threshold $T_P$, the controller 120 or drive system ECU 136 may stop and/or reverse the drive system 22, as represented by operation 220. If the door assembly is moved from the open position to the closed position, the latch assembly 28 may move from an open position to a secondary latch position, as represented by operation 226. In response to the latch assembly moving to the secondary latch position, latch signals 128 may be sent to the controller 120. In response to receiving the signals 128, the cinching mechanism may be actuated in operation 228 to move the latch from the secondary latch position to the primary latch position as represented by operation 230.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A door drive assembly for a bus provided with a body defining an opening and a door configured to move away from and along the body, the door drive assembly comprising:

a drive arm including a first end configured to be rotatably coupled to the body and a second end configured to be rotatably coupled to the door;

a drive mechanism coupled to the drive arm and configured to rotate the drive arm between an open position and a closed position;

a control arm including a first end configured to be rotatably coupled to the body and a second end configured to be rotatably coupled to the door; and a race configured to be disposed between the body and the first end of the control arm wherein the first end of control arm is configured to translate by a first distance along the race to move the control arm towards the drive arm to increase a pitch of the second end of the control arm as the drive arm rotates between the open and closed positions.

2. The door drive assembly of claim 1, further comprising a guide arm disposed between the control and the drive arm, wherein the guide arm is configured to separate the drive arm from the control arm by a predetermined distance.

3. The door drive assembly of claim 2, wherein the guide arm includes a first end and a second end, wherein the first end of the guide arm is pivotally connected to the drive arm and wherein the second end is pivotally connected to the control arm.

4. The door drive assembly of claim 3, wherein a distance between the first end of the drive arm and the first end of the guide arm is less than a distance between the first end of the guide arm and a second end of the drive arm.

5. The door drive assembly of claim 1, further comprising a bracket that is attachable to the body wherein the bracket is provided with a slot and wherein an inner surface of the slot defines the race.

6. The door drive assembly of claim 5, wherein the bracket is arranged along a first plane and wherein the slot extends along a direction that is parallel to the first plane.

7. The door drive assembly of claim 5, wherein the drive mechanism includes a main shaft, wherein when in the closed position the second end of the control arm is spaced apart from the main shaft by a first distance, wherein when in the open position, the second end of the control arm is spaced apart from the main shaft by a second distance less than the first distance.

8. The door drive assembly of claim 7, wherein the first distance and the second distance are inversely proportional.

9. The door drive assembly of claim 8, further comprising a compression spring disposed within the slot and the control arm wherein the compression spring biases the control arm away from one end of the slot.

10. The door drive assembly of claim 9, further comprising a bushing fixed to the first end of the control arm and configured to translate along the race.

11. The door drive assembly of claim 10, wherein the bushing has a rectangular shape.

12. A door drive assembly for a bus provided with a body defining an opening and a door configured to move away from and along the body, the door drive assembly comprising:

a drive arm including a first end configured to be rotatably coupled to the body and a second end;

a control arm including a first end configured to be rotatably coupled to the body and a second end;

a door attachment bracket pivotally attached to the second end of the drive arm and the second end of the control arm;

a drive mechanism coupled to the drive arm and configured to rotate the drive arm so that the door attachment bracket moves from a closed position to a first open position and from the first open position to a second open position; and a race configured to be disposed between the body and the first end of the control arm, wherein, when the door attachment bracket is in the closed position, the first end of the control arm contacts a first end of the race, when the door attachment bracket is in the first open position the door attachment bracket is spaced apart from the body, and when the door attachment bracket is in the second open position, the first end of the control arm is spaced apart from the first end of the race.

13. The door drive assembly of claim 12, further comprising a guide arm disposed between the control and the drive arm, wherein the guide arm is configured to separate the drive arm from the control arm by a predetermined distance.

14. The door drive assembly of claim 13, wherein the guide arm includes a first end and a second end, wherein the first end of the guide arm is pivotally connected to the drive arm and wherein the second end is pivotally connected to the control arm.

15. The door drive assembly of claim 14, wherein a distance between the first end of the drive arm and the first end of the guide arm is less than a distance between the first end of the guide arm and a second end of the drive arm.

16. The door drive assembly of claim 12, further comprising a bracket that is attachable to the body wherein the bracket is provided with a slot and wherein an inner surface of the slot defines the race.

17. The door drive assembly of claim 16, wherein the bracket is arranged along a first plane and wherein the slot extends along a direction that is parallel to the first plane.

18. A bus including a door and a body defining an opening, the bus comprising:

a drive arm including a first end configured to be rotatably coupled to the body and a second end configured to be rotatably coupled to the door;

a drive mechanism coupled to the drive arm and configured to rotate the drive arm between an open position and a closed position;

a control arm including a first end configured to be rotatably coupled to the body and a second end configured to be rotatably coupled to the door; and a race configured to be disposed between the body and the first end of the control arm wherein the first end of control arm is configured to translate by a first distance along the race to move the control arm towards the drive arm to increase a pitch of the second end of the control arm as the drive arm rotates between the open and closed positions.

19. The bus of claim 18, further comprising a bracket fixed to the body wherein the bracket is provided with a slot and wherein an inner surface of the slot defines the race.

* * * * *